US006422950B1

(12) United States Patent
Whitlam

(10) Patent No.: US 6,422,950 B1
(45) Date of Patent: Jul. 23, 2002

(54) PUTTER SOLE PLATE INSERT SYSTEM

(75) Inventor: David Whitlam, Solana Beach, CA (US)

(73) Assignee: Whitlam International, Inc., Solana Beach, CA (US)

( * ) Notice: Subject to any disclaimer, the term of this patent is extended or adjusted under 35 U.S.C. 154(b) by 0 days.

(21) Appl. No.: 09/659,473

(22) Filed: Sep. 11, 2000

(51) Int. Cl.[7] ..... A63B 53/04; A63B 53/02; A63B 53/06

(52) U.S. Cl. ..... 473/313; 473/334; 473/340; 473/341; 473/349

(58) Field of Search ..... 473/324, 340, 473/341, 313, 251, 349, 350, 334, 335, 336, 337, 338, 339, 305, 246, 248

(56) References Cited

U.S. PATENT DOCUMENTS 1,892,482 A * 12/1932 Cash
4,869,507 A * 9/1989 Sahm
4,984,799 A * 1/1991 Finney
5,060,950 A * 10/1991 Finney
5,137,275 A * 8/1992 Nelson
5,226,654 A * 7/1993 Solheim
5,230,509 A * 7/1993 Chavez
5,324,033 A * 6/1994 Fenton
5,333,870 A * 8/1994 Stevenson
5,533,730 A * 7/1996 Ruvang
5,655,976 A * 8/1997 Rife
5,769,737 A * 6/1998 Holladay
5,938,540 A * 8/1999 Lu

* cited by examiner

*Primary Examiner*—Sebastiano Passaniti
(74) *Attorney, Agent, or Firm*—Freling E. Baker

(57) ABSTRACT

A golf putter having a replaceable sole insert for varying putter head weight distribution along the length of the face. The putter has relatively thin face and sole central regions, with much thicker and heavier heel and toe regions. The central region of the sole is cut out. The cut out area has two opposite parallel recessed edges extending away from the back of the putter towards the face. An insert is configure to fit in the cut out area, with edges of the insert engaging the recessed edges to retain the insert in place. The sole may be flat or radiused, and the insert may have a lower surface corresponding to the sole. A neck connects the putter head to a shaft receiving hosel. The hosel has an outer end that is cut at an angle corresponding to the upper surface of the putter.

13 Claims, 2 Drawing Sheets

PUTTER SOLE PLATE INSERT SYSTEM

FIELD OF THE INVENTION

This invention relates to golf clubs and in particular to putter heads.

BACKGROUND OF THE INVENTION

A wide variety of golf clubs have been developed, with different appearance from different materials. The design of putters has continuously evolved. Essentially all putters have a hosel for receiving and connecting to the club shaft, a connection to a blade and a blade for striking the ball. The blade may have different angles to the vertical and different weight distributions intended to assure that the ball will move directly from the putter upon impact, with a desired top spin while avoiding side spin and ball skidding.

Putters are made from a variety of materials. Generally, putters are formed from metal by casting or machining. Others have areas of composite, plastic and wood. Weight distribution along a putter blade can influence effectiveness. Some putters concentrate weight along the lower edge, others along the upper edge and still other towards the center or ends of the putter.

In some circumstances, it is desirable to be able to vary the putter weight balance and total weight to accommodate different conditions and different players.

There is a continued need and desire for putters that will consistently propel the ball along the desired line and to a desired varying distance, will produce little, if any side spin, will not cause the ball to skid upon impact and twist significantly if the putter contacts the green surface during the putt.

SUMMARY OF THE INVENTION

The above-noted problems, and others, are overcome in accordance with this invention by a putter having a variable putter sole plate insert system which includes a putter having a substantially flat face angled back from vertical up to about 5°, the face having a center section and two end sections, the center section having a uniform, relatively thin, thickness and the end sections having a predetermined end mass of material behind the face. The putter has a sole which is preferably curved in an arc having a radius of from about 10 to 13 inches in the heel and toe portions and a radius in a from about 2 to 3 inch center section of from about 20 to 26 inches. The center region of the sole is cut away, with the end mass extending above the sole. An extension connects the top of the putter face to a hosel, with the hosel centerline spaced forward of the top edge of the putter face from about 0.375 to 0.750 inch.

Interlocking means are provided at the ends of the cut away region, so that an insert of different material can be locked to the putter. the insert is formed from any suitable relatively light weight material. The remainder of the putter is formed from a relatively heavier material, such as stainless steel. The light weight sole insert has been found to elevate the putter center of gravity, with the center of gravity increasing from the sole plate up to the top of the blade. This has been found to increase top spin, reduce ball skid upon initial contact of the ball and putter face, reduce side spin by providing a larger sweet spot.

Typical light weight materials suitable for use in the insert include aluminum, copper, various plastics such as epoxies, acrylics and acetyls, graphite, titanium, wood, rubber and combinations thereof. The insert may be electroplated, painted with colored or clear coatings, anodized, etc. The body of the putter may be formed from any relatively heavy, sturdy and wear resistant material such as stainless steel, brass, or combinations thereof.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
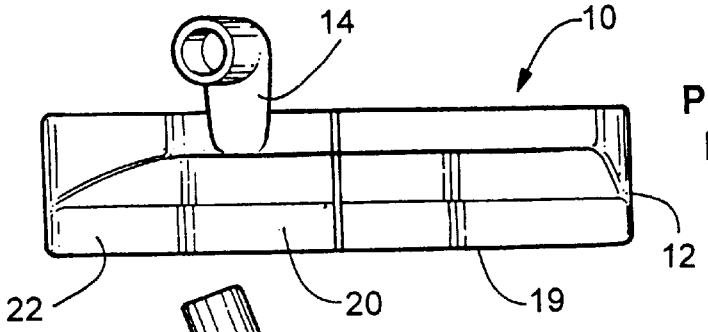
PRIOR ART Figure 1
FIG. 1 is a plan view of a prior art putter.
Figure 2:
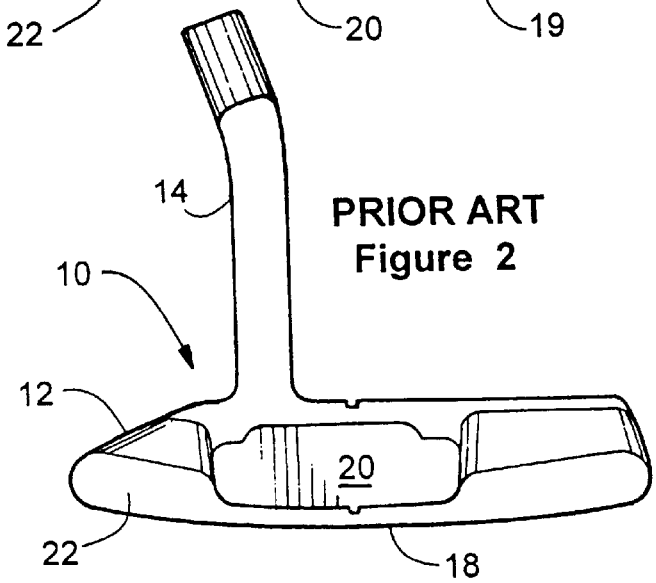
PRIOR ART Figure 2
FIG. 2 is a back elevation view of the prior art putter of FIG. 1.
Figure 3:
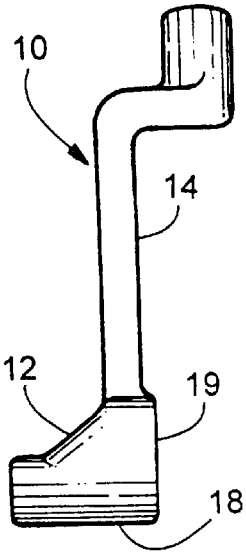
PRIOR ART Figure 3
FIG. 3 is toe end view of the prior art putter of FIG. 1.
Figure 4:
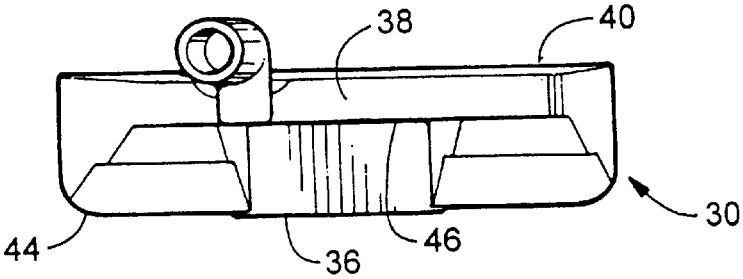
FIG. 4 is a plan view of the putter of this invention.
Figure 5:
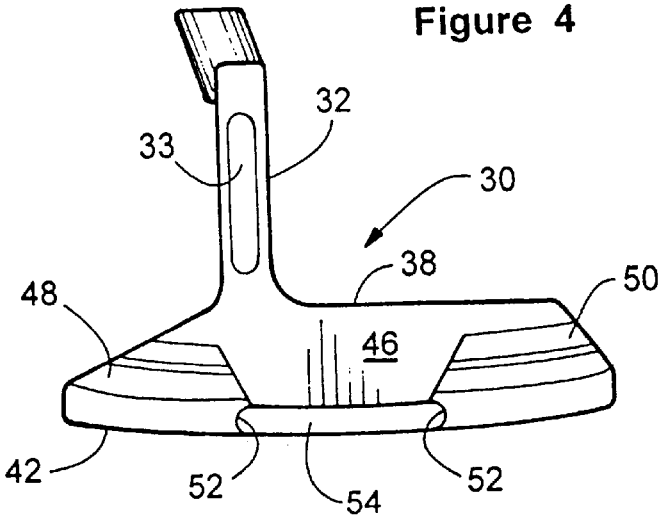
FIG. 5 is a back elevation view of the putter of FIG. 4.
Figure 6:
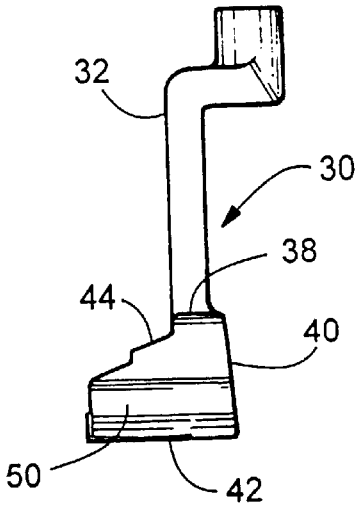
FIG. 6 is a toe end view of the putter of FIG. 4.
Figure 7:
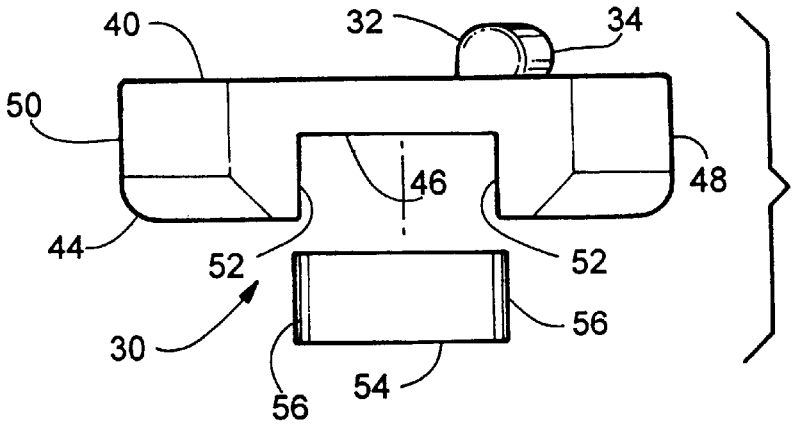
FIG. 7 is a bottom view of the putter of FIG. 4.
Figure 8:
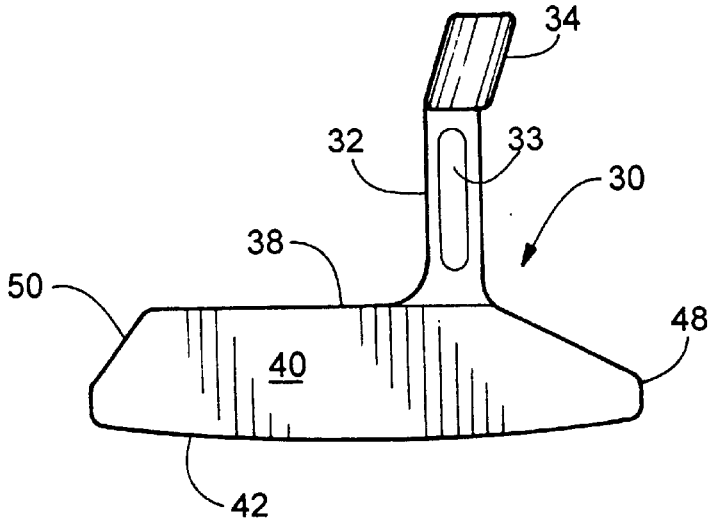
FIG. 8 is an elevation view of the face of the putter of FIG. 4.
Figure 9:
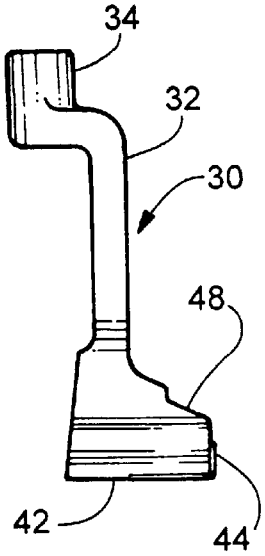
FIG. 9 is a heel elevation view of the putter of FIG. 4.

Referring to FIGS. 1–3 is seen a modern, prior art putter 10. Putter 10 includes a head 12 with an offset neck 14 connecting the head to a hosel 16 for receiving a putter shaft (not shown). Hosel 16 is basically a cylindrical tube, having a shaft receiving end that is square to the hosel centerline. Neck 14 normally has cross section between rectangular and circular.

Head 12 has a sole 18 which may be flat or slightly curved. A flat face 19 lies at an angle to sole 18 which is generally 90°. Putter head 12 has a thin central region 20 with heel region 22 and toe region 24 being considerably thicker.

With such conventional putters, a player cannot modify or select different head characteristics, in particular the weight relationship between central region 20 and the heel and toe regions 22 and 24 respectively.

Details of the improved putter with a variable weight relationship between the central and end regions are provided in FIGS. 4–10. As shown, the novel putter 28 includes a head 30, including a neck 32 and a hosel 34. Preferably, neck 32 has a longitudinal recess 33 along one or both of the front and back surfaces to reduce weight while retaining maximum strength.

Head 30 has a top surface 38 which is preferably flat and forms a line of sight for a golfer to orient perpendicular to the intended path of a putted ball. A generally flat face 40 and a sole 42 form the front and bottoms surfaces of the head. Sole 42 can be flat or convex, as desired. Face 40 preferably has an angle to sole 42 of about 3 to 4.5° Back surface 44 is irregular in shape and completes the head.

Central region 46 in head 30, between face 40 and back surface 44 is relatively thin, so that most of the head weight is concentrated in the heel 48 and toe 50, which are thicker between face 40 and back surface 44 and between the sole 42 and top surface 38.

Figure 10:
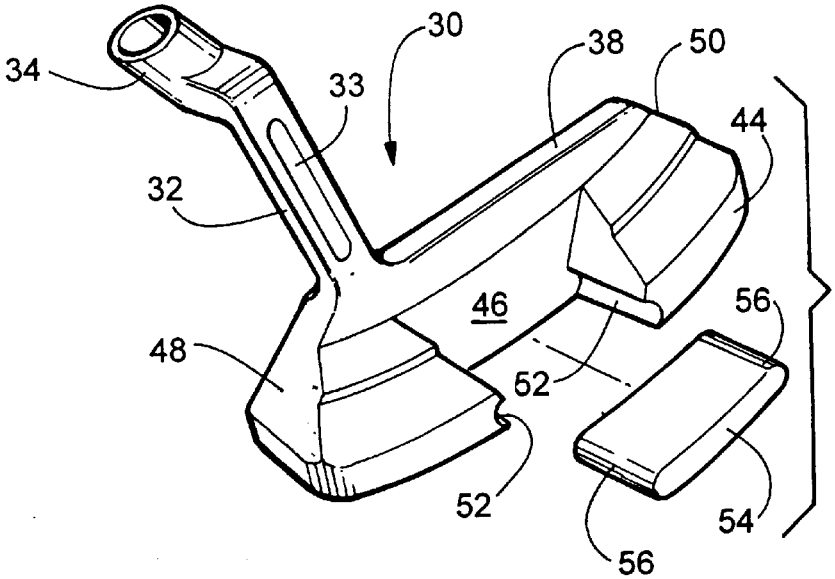
FIG. 10 is a rear perspective view of the putter of FIG. 4 showing the sole insert.

Sole 42 is cut out as best seen in FIG. 10, with recessed edges 52 extending away from back surface 44 and lying parallel to each other. Preferably, edges 52 are substantially perpendicular to back surface 44.

An insert 54 (as best seen in FIG. 10) has edges 56 configured to slidably fit into the cut out region between edges 52. The weight of insert 54, both in volume and material, may be varied to vary the weight of central region 46 relative to heel 48 and toe 50. Many players, prefer a relatively light insert 54 to reduce the tendency of a putter to twist on off. center face impacts with the ball. Others prefer the solid feel of slightly more even weight distribution along the face. Typically, head 30 may weight from about 275 to 400 grams and insert 54 may weigh from 2 to 150 grams. Insert 54 preferably is firmly mounted in the cut out region, typically by adhesive bonding, soldering, swaging and the like. The insert can be removed and replaced with an insert of different weight by technicians with appropriate tools or by factory employees.

Typical materials that can be used for insert 54 include aluminum, plastics such as acetyl, epoxy and acrylic resins, copper, graphite, steel, depleted uranium, tungsten, brass, titanium, wood, rubber, fiber filled plastics, foamed plastics etc. The inserts may be electroplated, painted or otherwise coated, if desired. Typically, inserts will weigh from about 2 to 150 grams of these, aluminum and acetyl resins such as that sold under the Delrin® trademark are preferred for relatively light weight inserts and depleted uranium, steel and tungsten for relatively heavy insets.

Inserts and heads may be manufactured in any suitable manner, such as casting and numerical controlled machining. Inserts may have any suitable dimensions. Preferably, inserts having widths from about 0.25 to 2 inches, lengths of from about 0.5 to 3.5 inches and thickness of about 0.0625 to 0.5 inch give best results. For best results the heel and toe regions will have thicknesses of at least 1.5 inches when measured from face to back and from sole to top. The central face thickness is preferably about 0.2 to 0.5 inch. In general, the face and insert thicknesses should be less than about 20% of the corresponding heal and toe region thicknesses.

Other applications, variations and ramifications of this invention will occur to those skilled in the art upon reading this disclosure. Those are intended to be included within the scope of this invention, as defined in the appended claims.

I claim:

1. An improved golf putter head which comprises:

a face for striking a golf ball;

a sole for positioning adjacent to a golf green surface;

a back surface;

a heel region and a toe region;

a top surface lying substantially parallel to said sole;

an elongated neck fixed to and extending from said top surface and including a hosel with said hosel fixed at an angle to said sole and positioned forward of said face;

said hosel having an opening for receiving a putter shaft;

said head having a thickness between said face and back surfaces that varies in the heel and toe regions from a maximum at the sole to a minimum at the top surface, and a thickness in a central region of less than 20% of the thickness in the heel and toe regions;

said sole having a thickness in said central region of less than about 20% of the thicknesses in said heel and toe regions;

said sole having a cut out region extending from said back surface toward said face;

said cut out region having parallel recessed edges; and an insert configured to fill at least some of said cut out region and having edges configured to slide into said recessed edges.

2. The putter according to claim 1 wherein the density of said insert material differs from the density of said club head material.

3. The putter according to claim 1 wherein said overall putter head weight with said insert is from about 275 to 400 grams and said insert weight is from about 5 to 150 grams.

4. The putter according to claim 1 wherein said insert has a width of from about 0.25 to 2 inches, a thickness of from about 0.0625 and 0.5 inch and a length of from about 0.5 to 3 inches.

5. The putter according to claim 1 wherein said head is formed from stainless steel and said insert is formed from aluminum.

6. The putter according to claim 1 wherein said neck has at least one recess parallel to said elongation.

7. The putter according to claim 1 wherein said heel and toe regions have thicknesses at least about 1 inch, from face to back surface.

8. The putter according to claim 1 wherein said heel and toe regions have thicknesses at least about 1.5 inch, from sole to top surface.

9. An improved golf putter head which comprises:

a face for striking a golf ball;

a sole for positioning adjacent to a golf green surface;

a back surface;

a heel region and a toe region;

a top surface lying substantially parallel to said sole;

an elongated neck fixed to and extending from said top surface and including a hosel with said hosel fixed at an angle to said sole and positioned forward of said face;

said neck having at least one recess parallel to said elongation;

said hosel having an opening for receiving a putter shaft;

said head having a thickness between said face and back surfaces that varies in the heel and toe regions from a maximum at the sole to a minimum at the top surface, and a thickness in a central region of less than 20% of the thickness in the heel and toe regions;

said sole having a thickness in said central region of from about 0.0625 and 0.5 inch and a thickness in said heel and toe regions of at least three times the thickness of said central region;

said sole having a cut out region extending from said back surface toward said face;

said cut out region having parallel recessed edges extending from said back surface; and an insert configured to fill at least some of said cut out region and having edges configured to slide into said recessed edges.

10. The putter according to claim 9 wherein the density of said insert material differs from the density of said club head material.

11. The putter according to claim 9 wherein said overall putter head weight with said insert is from about 275 to 400 grams and said insert weight is from about 5 to 150 grams.

12. The putter according to claim 9 wherein said insert is formed from materials selected from the group consisting of aluminum, plastics including acetyl, epoxy and acrylic resins, copper, graphite, steel, depleted uranium, tungsten, brass, titanium, wood, rubber, fiber filled plastics, foamed plastics and mixtures and combinations thereof.

13. The putter according to claim 9 wherein said head is formed from stainless steel and said insert is formed from aluminum.

* * * * *